US007247049B2

(12) United States Patent
Ratican

(10) Patent No.: US 7,247,049 B2
(45) Date of Patent: Jul. 24, 2007

(54) HANGING LAMP CONVERSION CONNECTOR

(76) Inventor: Walter Ratican, 443 NE. Little Mullet Ct., Port St. Lucie, FL (US) 34983

( * ) Notice: Subject to any disclaimer, the term of this patent is extended or adjusted under 35 U.S.C. 154(b) by 0 days.

(21) Appl. No.: 11/388,736

(22) Filed: Mar. 24, 2006

(65) Prior Publication Data

US 2006/0216985 A1 Sep. 28, 2006

Related U.S. Application Data

(60) Provisional application No. 60/665,681, filed on Mar. 28, 2005.

(51) Int. Cl.
*H01R 13/60* (2006.01)

(52) U.S. Cl. ..... 439/537; 439/236

(58) Field of Classification Search ..... 439/529, 439/641, 643, 648, 657, 661, 531, 576, 537, 439/302, 306, 236
See application file for complete search history.

(56) References Cited

U.S. PATENT DOCUMENTS 4,046,448 A 9/1977 Miller
4,183,604 A * 1/1980 Tjornhom, Sr. ..... 439/300
4,327,402 A 4/1982 Aubrey
4,565,419 A * 1/1986 Johnson et al. ..... 439/641
4,595,969 A 6/1986 McNair
4,655,531 A * 4/1987 Delaney ..... 439/531
4,807,099 A 2/1989 Zelin
4,956,758 A 9/1990 Aubrey et al.
7,153,167 B1 * 12/2006 Switzer ..... 439/642
2003/0235049 A1 12/2003 Wu
2006/0013009 A1 * 1/2006 Falco, Jr. ..... 362/418

* cited by examiner

*Primary Examiner*—Tho D. Ta
*Assistant Examiner*—Vanessa Girardi
(74) *Attorney, Agent, or Firm*—Paul M. Denk

(57) ABSTRACT

A hanging lamp conversion connector for supporting a suspended lamp, and which can threadedly engage within the socket of a recessed lighting fixture, once its lamp has been removed, provides for an instant conversion of a recessed light or ceiling socket to a hanging lamp, for installation within any facility. It includes a housing, of a light socket, into which a single or double threaded plug may locate, and which provides an upward orientation of the upper threaded plug with a light socket for threading directly into the recessed lighting fixture, for installation. Such a connector can be easily removed, by unthreading the lamp and the lamp can be replaced with another, or a different reflector, or shade, to add to the variety of uses and multiple displays associated with a variety of suspended and hanging lamps.

5 Claims, 4 Drawing Sheets

HANGING LAMP CONVERSION CONNECTOR

CROSS REFERENCE TO RELATED APPLICATION

This non-provisional application claims priority to the provisional application for patent Ser. No. 60/665,681 which was filed on Mar. 28, 2005.

BACKGROUND OF THE INVENTION

This invention relates generally to the mounting of a lighting fixture, and more specifically pertains to a conversion connector that provides for the changing of a ceiling lamp, such as a recessed light, to a hanging style of lamp that can be easily changed, at the desire of the occupant, so as to convert quickly the style of decorative light hanging within a facility.

Lighting for the home, business installation, a restaurant, night club, bar, or any other business establishment, has long been available in the art. Of more recent vintage, though, the use of recessed lighting has become quite in vogue over the past twenty-five to thirty years. Recessed lighting can now be found in restaurants, taverns, even in business establishments, where the lights are mounted into a false ceiling, and such type of recessed lighting has even become stylish for installation into the residential building. Such lighting is not only attractive, but has been readily accepted by the home or business owner, to sustain its popularity.

Furthermore, in earlier years, a suspended or hanging type of light was of interest to particularly the homeowner, where a suspended light could be located over an end table, kitchen table, dining table, or any other location, where more proximate lighting was desired. But, when recessed lighting is installed within a facility, few means exist to allow an owner to convert from that type of lighting, to a suspended or hanging lamp, when desired.

A variety of patents have issued upon various types of lighting systems. For example, the U.S. patent to Miller, U.S. Pat. No. 4,046,448, shows a lighting fixture accessory, which is basically a telescoping type of housing for use for supporting a light socket, so that the housing can be expanded, or contracted, as desired, within a light socket of a facility.

The U.S. patent to Aubrey, U.S. Pat. No. 4,327,402, shows another light fixture. In this particular instance, the light fixture and its housing can be extended downwardly, by disengaging various latches, to allow for a lengthening of its light support, to bring the light either closer to the source of usage, or it can be contracted back up towards the ceiling, as desired.

The U.S. patent to McNair, U.S. Pat. No. 4,595,969, shows a lamp mounting apparatus and method. This apparatus is identified as for use for fitting within a recessed type of lighting fixture. But, the reflector of the shown light actually fits against the cover of a recessed receptacle, of the recessed lighting, and does not really provide for any extension or hanging of a lamp therefrom, because it appears that the reflector is originally connected up to and against the recessed fixture, during its assembly.

The patent to Zelin, U.S. Pat. No. 4,807,099, shows another lighting fixture. This particular device, as with some of the previously patented devices, is more concerned with furnishing fluorescent lighting, and its fixture, that may be interchangeable with an incandescent lighting fixture, that is recessed within the ceiling. As can be seen, it appears that the lighting fixture of this invention incorporates a lip adapter, which apparently is intended to conform to the light fixture that is mounted into the ceiling, of the recessed lighting installation, and not as a hanging lamp.

Another U.S. patent to Aubrey, et al., U.S. Pat. No. 4,956,758, shows a lamp mounting apparatus and method. Once again, this particular lamp mounting apparatus provides means for converting from an incandescent to a fluorescent type of light. In its design, it incorporates its fixture, to fit within the conventional recessed lighting fitting, so that its shoulder will bias against the recessed housing. And, the fluorescent lighting is then hardwired through wiring, into the ceiling, and connected through its screw connector, into the recessed lighting socket. Once again, this device relates to a lamp mounting apparatus, rather than means to provide for exchanging of a hanging lamp, into a recessed lighting fixture.

Finally, the published application of Wu, No. US 2003/0235049, shows a decoration bulb assembly. This device does not appear to relate to any type of recessed lighting fixture, but rather, simply discloses a decorative type of bulb, that emanates from its adapter, that can simply be screwed directly into a socket, at the ceiling or surface level of the facility. This does not relate to any type of an extension or converter for furnishing support, structurally, for a hanging lamp, from a recessed lighting fixture.

SUMMARY OF THE INVENTION

This invention relates generally to a hanging light conversion connector, and more specifically to a uniquely designed connector that can plug into a recessed lighting receptacle, and convert the lighting to a suspension or hanging lamp, at the desire of the occupant.

As previously stated, in reviewing the background of this invention, recessed lighting has long been available in the art. The concept of this invention is to convert the recessed light, to a hanging lamp, so that a variety of lamps, and their particular designs or ornamental appearances can be changed, at the selection of the occupant, as desired. For example, hanging lamps can be applied that reflect the seasons of the year, as within a restaurant, a sports bar, and the like. Or, depending upon the game to be televised in the sports bar for that day, the hanging lamps could be installed that display the various competing teams' colors, emblems, or the like, to add to the enthusiasm of the crowd.

In its primary construction, the concept of this invention is to replace the flood lamp, of a recessed light, with a hanging light fixture. The hanging light fixture can be screwed into the recessed lighting socket. Essentially, this invention is a type of uniquely designed screw-in plug, that can be threadedly engaged into the light fixture, even up in its recessed area, and the connector can have a screw-in type of plug, of the type that a lighting fixture can be hardwired to, and connected to its base, for support for the hanging lamp, during installation. The connector has a light type socket, provided at its bottom, and the wires from the lamp will extend into its opening, and be hardwired therein. Then, the double ended threaded connector will rotate its threads into the upper end of the socket, and the other threaded end of the double plug can rotate its threads directly into the socket provided in the removed recessed light. A hanging lamp can then be screwed directly into the socket for the recessed lighting fixture. Thus, when the light switch for the recessed light is turned on, the hanging lamp will light, to provide for illumination, and the reflection of the design, indicia, or coloration, that is desired for the style of hanging lamp connected thereto. As stated, in this manner, a variety of hanging lamps can be interchanged, for displaying something that may bring lighting closer to the user, or to add to the decorativeness of the facility.

It is, therefore, the principal object of this invention to provide means for converting a recessed light fixture into a support and electrical connector for a hanging lamp, or a variety of hanging lamps for use in a facility, or even a house.

Still another object of this invention is to provide a conversion connector for a hanging lamp, that may be threadedly engaged directly into the socket of a recessed light, and thereby provide for not only the conversion of the lighting to a hanging lamp, but one that may be changed multiple times to vary the attractiveness and decorativeness of the lighting for the facility in which such hanging lamp is installed.

Yet another object of this invention is to provide a conversion connector that may be integrated into a thread-in plug, and yet provide terminals for hardwiring a hanging lamp thereto, when converting recessed lighting to a hanging lamp, within a facility or home.

Yet another object of this invention is to provide a conversion connector that can be promptly and easily installed, for changing residential or commercial lighting into the hanging style lamp.

These and other objects may become more apparent to those skilled in the art upon review of the summary of the invention as provided herein, and upon undertaking a study of the description of its preferred embodiment, in view of the drawings.

DESCRIPTION OF THE PREFERRED EMBODIMENT

Figure 1:
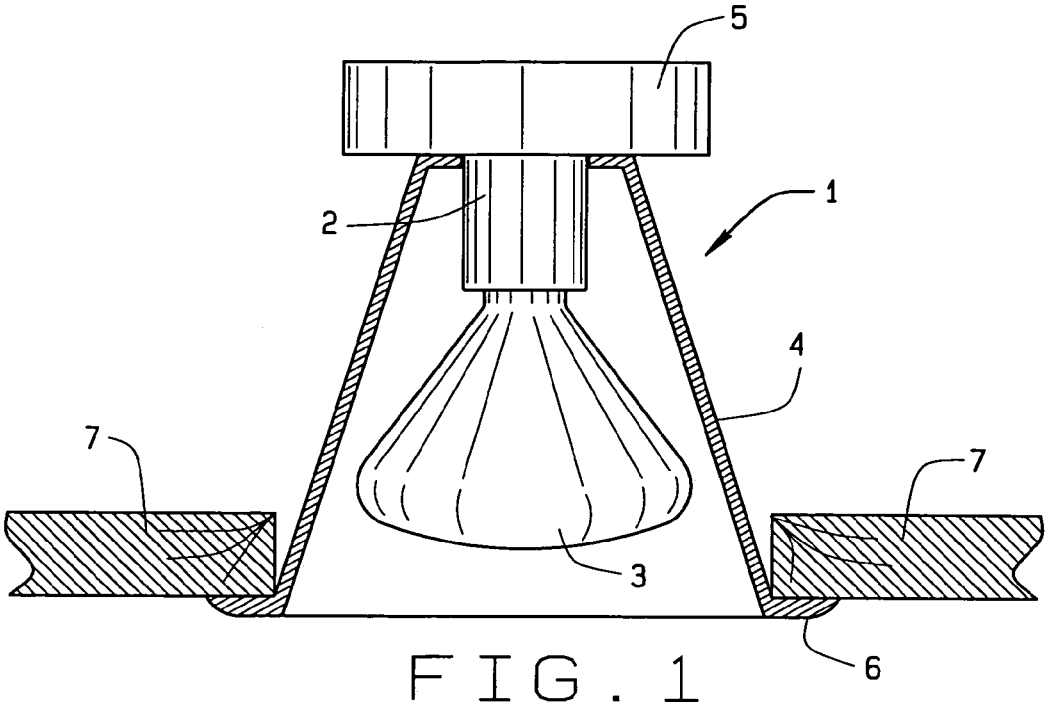
FIG. 1 PRIOR ART
FIG. 1 shows a prior art recessed lighting fixture, and its flood lamp, installed within a ceiling.

In referring to the drawings, FIG. 1 shows the standard style of recessed lighting fixture, as at 1, which has a socket 2, holding a lamp 3, as may be installed. The housing 4 for the recessed fixture secures to the socket base 5, at its upper end, and at its lower end, normally includes flanges, or at least a continuous flange, as at 6, and which supports or connects with the ceiling material 7 normally of a suspended ceiling structure.

Figure 2:
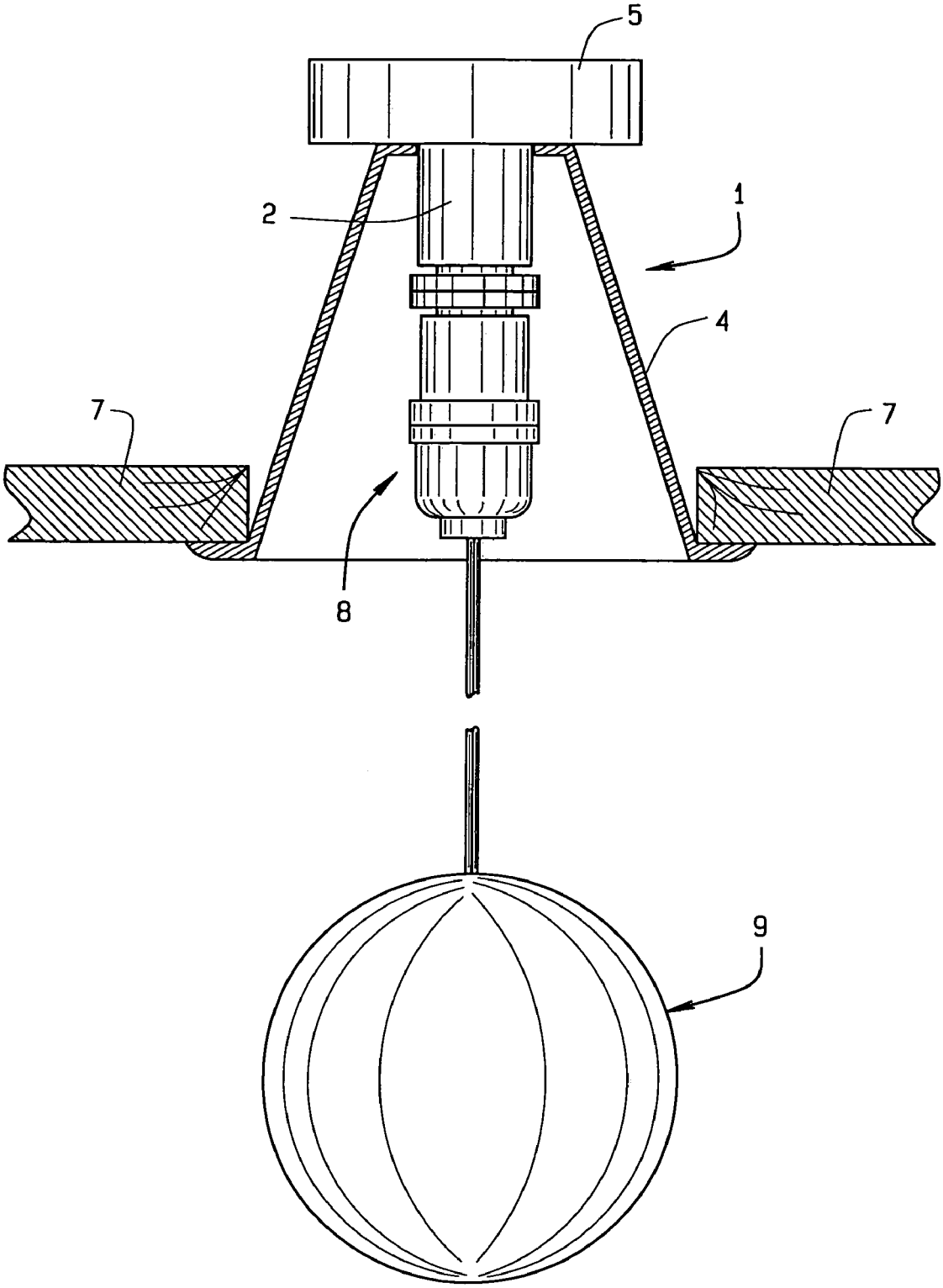
FIG. 2 shows the conversion of the recessed lighting fixture into an electrical and structural support for a hanging lamp.

FIG. 2 shows similar type of structure, for a recessed lighting fixture, but in this instance, includes the conversion connector 8 that threadedly engages within the socket 2, and provides for suspending of the hanging lamp 9.

Figure 3:
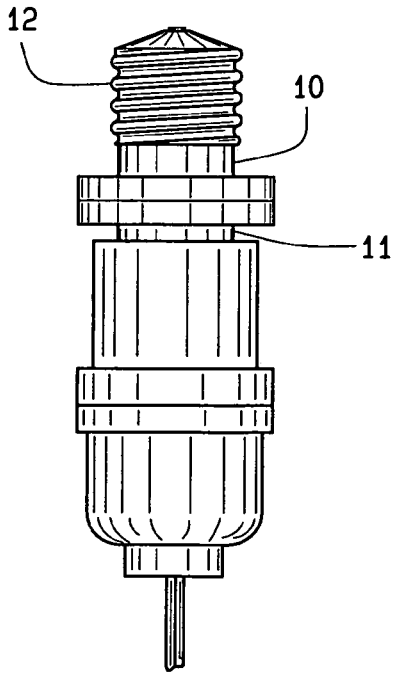
FIG. 3 shows the conversion connector, enlarged, as disclosed in FIG. 2.
Figure 4:
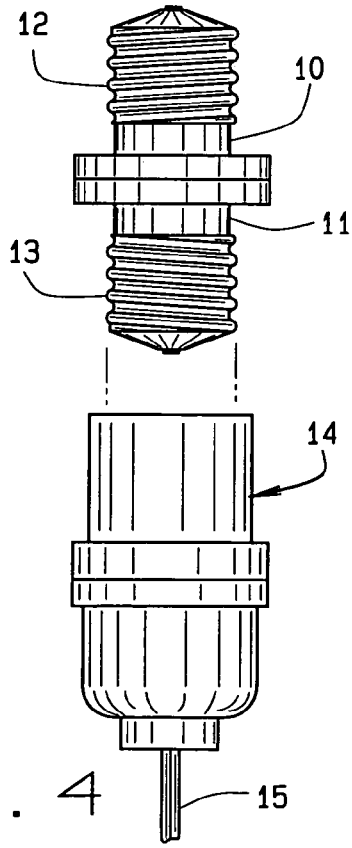
FIG. 4 shows the double ended plug removed from the light socket for the hanging lamp.

The conversion connector of this particular invention is also shown in FIGS. 3 and 4. It includes a double ended threaded engaging plug, the two plugs being connected back to back, as can be seen at 10 and 11. Normally, each of these plugs are of the standard type, which includes its threaded segment 12 which in this instance, can threadedly engage directly into any socket 2 for a recessed lamp, while the other plug likewise includes a series of threads, as at 13, and which can thread directly into a light socket, as at 14, of the type as known in the art. When the conversion connector is assembled in this manner, the electrical wires 15 from the hanging lamp, can be connected into the connector, internally, thereat as known in the art, and the double plug can then be threadedly engaged therein, within the light socket 14, but also into the socket 2 for the recessed lighting fixture, to provide for an instant conversion of the flood lamp 3, into a hanging lamp, and as previously explained, with respect to FIG. 2.

Figure 5:
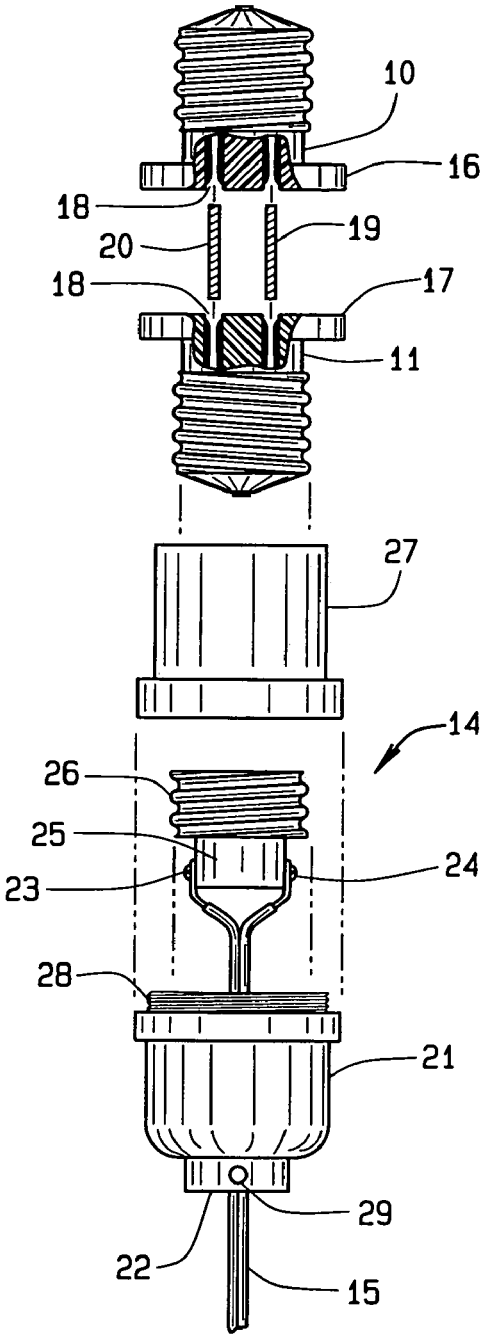
FIG. 5 shows an exploded view of the double ended threaded plug, with the electrically conductive tabs arranged intermediate thereof, and which can be threadedly engaged within the lamp socket for the hanging lamp.

The specific construction of the conversion connector 8, as previously explained, can be seen in FIG. 5. Each of the threaded plugs 10 and 11, as known, at their flanged ends, as at 16 and 17, have their plug in openings 18 and before these two plugs are sealed together, either by adhesive, or molding, as along the surface of their flanges 16 and 17, the electrical conducting tabs 19 and 20 are inserted into their respective plug in locations, as at 18, to provide for electrical connection from the upper threaded plug 10, to the lower plug 11, once assembled and installed. The bottom portion of the conversion connector includes, what was previously identified as the light socket 14, and includes the base of the socket 21, having an opening at its lower end, as at 22, through which the electrical wiring 15 from the light fixture extends.

The pair of wires then connects by threaded fasteners, as at 23 and 24, to the base 25 of the threaded socket 26, as known in the art. Then, the upper part of the light socket, as at 27, is lowered to surround the threaded socket 26, and then threadedly engages onto the sleeve threads 28 of the lower portion 21 of the light socket, as can be seen. When the entire unit is assembled, so that it appears as shown in FIGS. 3 and 4, the double socket plugs 10 and 11 are then threaded into the sleeve threads 26, to provide for electrical connection completely through the conversion connector, which is then readily assembled for installation into the recessed lighting fixture socket 2, as described.

Thus, when assembled in that manner, the entire conversion connector has the appearance as shown in FIG. 2, it is generally concealed within the housing 4 of the recessed lighting fixture, and is not that observable to any occupant of the room, in which the hanging light fixture is located. In fact, because the light fixture 9 may have the variety of colors, designs, indicia, or other pictures applied thereto, the line of vision of the room occupant will be towards the fixture, and not up into the ceiling, as can be understood. While it is not shown, any type of reflector, or cover, can be applied at the base of the conversion connector, so as to cover the opening into the recessed lighting fixture housing 4, to provide greater concealment for the electrical installation. In addition, to provide greater support for the hanging lamp 9, a fastener, as at 29, may be provided at the bottom of the lamp socket, and be tightened about the wires, to support them in position, and to aid in supporting the weight of the hanging lamp fixture 9, once installed. Or any type of chain or other support can be applied, as known in the art.

Figure 6:
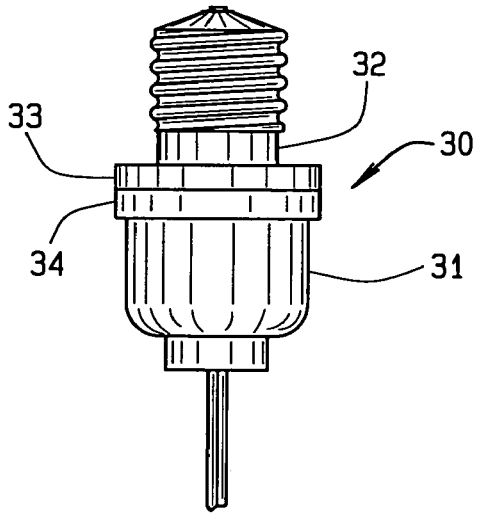
FIG. 6 shows a modification to the hanging light conversion connector of this invention.
Figure 7:
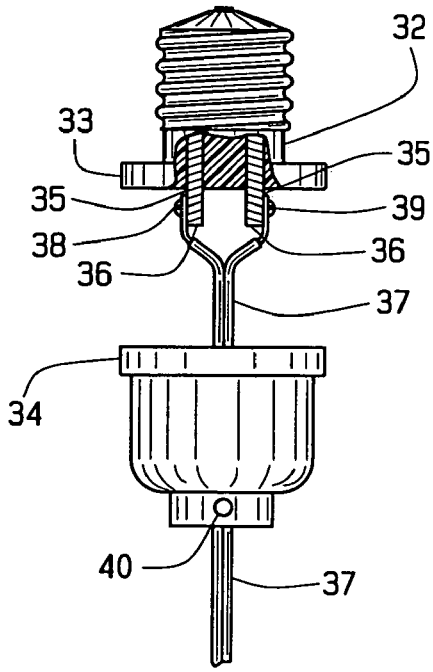
FIG. 7 discloses the modified conversion connector, in partial exploded view, having the electrical wiring from the hanging lamp extending into the connector and connecting with the terminal tabs of the socket plug.

FIGS. 6 and 7 disclose a further variation upon the conversion connector of this invention. The conversion connector, as shown at 30, includes the lower structure of the light socket, as can be seen at 31, and has a threaded plug 32 secured thereto, by means of an adhesive or other connection between their flanges 33 and 34, when connected together. Thus, when assembled in this manner, it can provide for electrical connection within the recessed lighting fixture, and its socket 2, but at the same time, support a hanging lamp, in the manner as previously described. Hence, because it may be desirable to separate the threaded plug 32, from the lamp base 31, the inner connection between the flanges 33 and 34 may be through a threaded connection, so that they may be unthreaded, for separation, to allow one to attain access into its internal electrical connectors, as can be seen in FIG. 7. As noted, the threaded plug 32 has its receptacle slots 35 provided therein. And, the electrical tabs 36 extend into the receptacles, to provide for electrical connection. Then, the electrical wires 37 from the hanging lamp can be fastened to each of the electrical tabs 38 and 39, so to conduct charge through the plug 32, from the socket 2, and through the electrical tabs 36, through the connected electrical wires 37, and to the hanging light fixture, to provide for its illumination, when charge is being conducted. In addition, once again, a fastener, as at 40, can secure the electrical wires 37, or an associated chain, to hold them in position, and to support the weight of any light fixture suspended therebelow.

In addition, it may be just as likely that the flanges 33 and 34 of the threaded plug 32, and the lamp housing 31, can be threadedly engaged together, in a manner similar to that which the upper socket housing 27 threadedly engages onto the threaded sleeves 28, of the lamp socket 14 as disclosed in FIG. 5.

Figure 8:
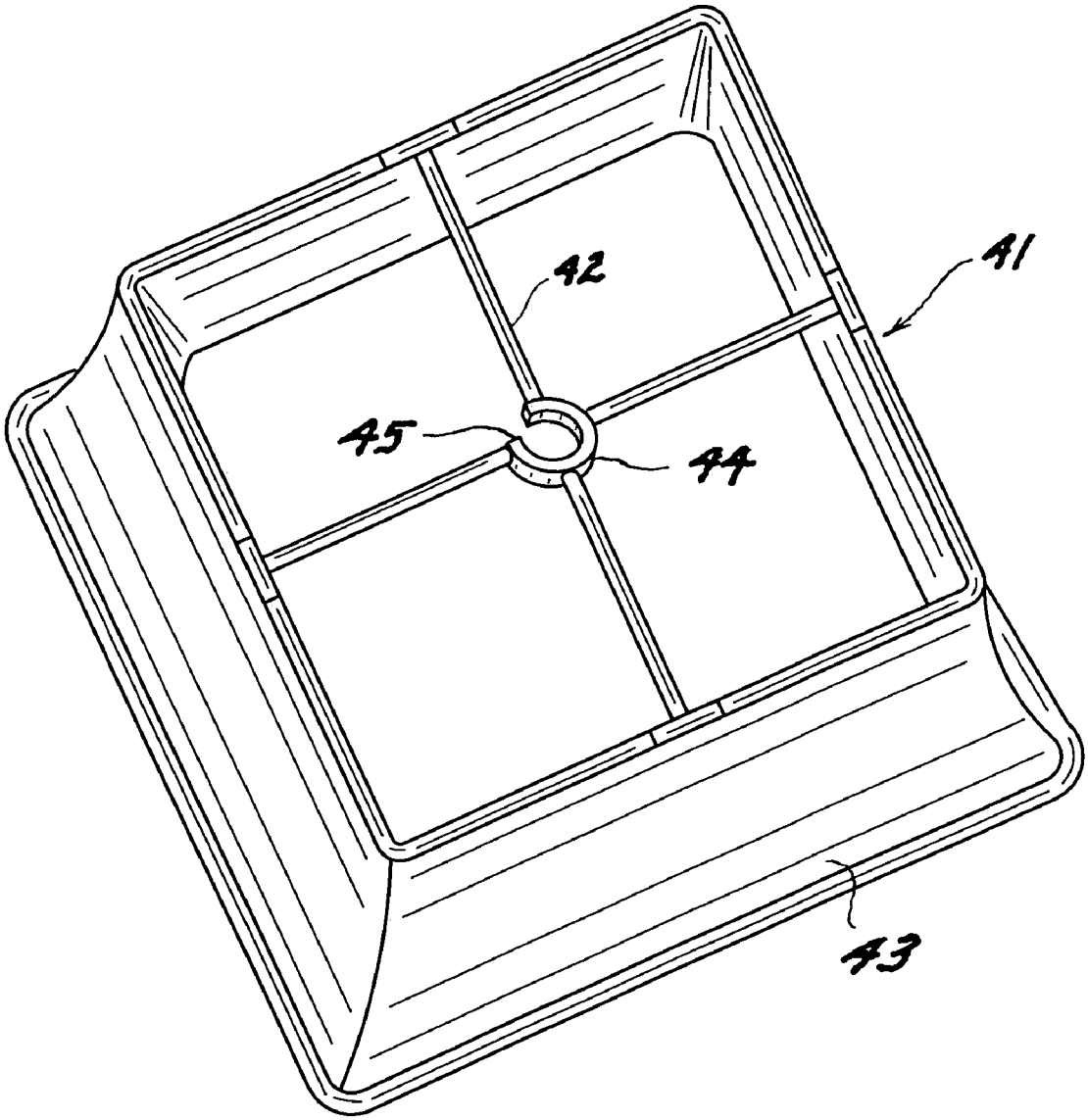
FIG. 8 is a perspective view of a type of shade that may be applied to the end of the hanging lamp to provide cover for the light, and to display various types of other decoration, such as emblems for sport teams, etc.

As shown in FIG. 8, this is an example of the type of shade that may be applied to the hanging lamp connector, at the lower end of its cord, and where the lamp will plug into the same. The type of shade or reflector that may be applied to the lamp, as previously described in FIG. 2, indicated at reference character 9. Different types of shades, globes, or any other types of reflector, that may bear indicia of different sport teams, community sites, even the name of the night-club or restaurant, or any type of nomenclature, as desired by the owner, can be used. As can be seen, in FIG. 8, shade 41 includes the usual frame 42, for supporting the shade covering 43, and the means for connection of the shade to the wires 15, 37, or even any chain that suspends from the connector 8, includes the supporting ring 44. In this particular instance, the supporting ring 44 includes a slot 45, and through this slot the cord will be applied, and then can be secured by any type of a fastener or any type of a threaded connecting means, that can hold the cord or chain to the ring 44, in suspension. The end of the electrical wires is a common type of screw in socket, similar to what has been described with respect to the light socket 14, but will be located at the opposite end of the wires, at its downward most point, and where the lamp will be reapplied, and one of the lamps, bowls, reflectors, such as 9, or shade 41, is applied thereat, for surrounding the light, and allow for projection of any applied indicia, trademarks, and the like.

It must also be commented herein that the type of hanging lamp conversion connector, is described as connecting within a recessed lighting fixture, could also be applied to any light socket in a ceiling, where it is desired to suspend a hanging lamp, in lieu of the ceiling light, to add to the decorativeness of the installation. Thus, in many old homes, and even contemporary ones, where light sockets are applied at ceiling level, regardless whether they are recessed or not, could use this conversion connector as a means for suspending and operating a hanging lamp, rather than a ceiling mounted fixture. This is an example as to how this conversion connector can be applied.

Hence, the essence of this invention is to provide a conversion connector, which has not been available in the prior art, and is not known to be available for use for converting a recessed lamp into a hanging lamp fixture, in the manner as described herein. Through the use of this type of conversion connector, the type of assembly, its installation, and replacement with another hanging lamp, can be readily achieved as described herein, for the installation as shown and explained.

Variations or modifications to the subject matter of this development may occur to those skilled in the art upon review of the invention as described herein. Such variations, if within the spirit of this development, are intended to be encompassed within the scope of the invention as explained. The description of the preferred embodiment and as shown in the drawings, are set forth for illustrative purposes only to show the principle of this hanging lamp conversion connector.

I claim:

1. A hanging lamp conversion connector for use for converting a recessed ceiling light socket to provide electrical connection to a hanging lamp, comprising:

said conversion connector including a pair of electrical plugs, each plug having a flange and an integral threaded segment extending from said flange, each plug having a pair of plug-in locations;

said pair of plugs being secured together into axial alignment wherein their flanges are secured together in back to back attachment;

a pair of tabs, said tabs locating within the pair of plug-in locations to provide for conduct of electrical charge through the attached pair of electrical plugs;

a light socket, said light socket threadedly engaging the threaded segment of one of the plugs therein, said light socket having an electrical wire extending downwardly therefrom, the other of said plugs connecting its threaded segment into the recessed light socket, and the light socket electrical wire connecting with a hanging lamp to provide for its electrical operation during usage.

2. The connector of claim 1 further comprising:

a shade having a frame positioning a covering outwardly from said lamp socket; and, said frame including a supporting ring generally centered within said shade, said ring having a slot therethrough adapting to admit the wires from a hanging lamp.

3. The hanging lamp conversion connector of claim 1 and including said light socket including a base, said base having an opening at its lower end and through which the electrical wire inserts, said base opposite from its lower end incorporating integral sleeve threads, an upper part of the light socket provided for threadedly engaging with said sleeve threads when the light socket is reconnected after wiring, a socket base included within the light socket, said socket base having an integral threaded socket at its upper location, and a pair of threaded fasteners at its lower location and to which the electrical wires connect, and said socket base locating within said upper part and base of the light socket when said parts are threadedly engaged together, and the electrical wire extending downwardly through the opening of the lower part of the light socket for connecting and suspending a hanging lamp thereto.

4. The hanging lamp conversion connector of claim 3 and including one of a shade, globe, and reflector connecting with the lower end of the light socket electrical wire to provide for suspension during operation.

5. The hanging lamp conversion connector of claim 1 and wherein the securement of the flanges of the pair of plugs together being by an adhesive, threaded connection, or integral molding.

* * * * *